US007354219B2

(12) United States Patent
Leonberg

(10) Patent No.: US 7,354,219 B2
(45) Date of Patent: Apr. 8, 2008

(54) MULTI-SEAL WATERPROOF EXPANSION JOINT FOR ROADWAYS

(76) Inventor: Douglas E. Leonberg, 9018 Marshall Rd., Cranberry Township, PA (US) 16066-3604

( * ) Notice: Subject to any disclaimer, the term of this patent is extended or adjusted under 35 U.S.C. 154(b) by 400 days.

(21) Appl. No.: 10/922,400

(22) Filed: Aug. 20, 2004

(65) Prior Publication Data

US 2006/0039753 A1 Feb. 23, 2006

(51) Int. Cl.
*E01C 11/02* (2006.01)
*E04B 1/684* (2006.01)

(52) U.S. Cl. ..... 404/58; 52/396.05; 404/47; 14/73.5

(58) Field of Classification Search ..... 52/393, 52/395, 396.03, 396.04, 396.05, 396.06, 52/396.07, 396.08, 396.09, 396.1, 396.01, 52/396.02, 402; 404/47, 49, 53–59, 61, 67–69, 404/64, 65, 66; 14/73.1, 73.5
See application file for complete search history.

(56) References Cited

U.S. PATENT DOCUMENTS 3,344,720 A * 10/1967 Hallock ..... 404/47
3,390,501 A * 7/1968 Driggers ..... 52/395
3,394,639 A * 7/1968 Viehmann ..... 404/47
3,520,236 A 7/1970 Sequaris
3,699,853 A 10/1972 Wicks, III
3,750,359 A * 8/1973 Balzer et al. ..... 52/468
3,797,188 A 3/1974 Mansfeld
3,992,121 A * 11/1976 Geiger ..... 404/47
4,111,583 A * 9/1978 Brady et al. ..... 404/69
4,271,650 A * 6/1981 Lynn-Jones ..... 52/395
4,295,315 A 10/1981 Lynn-Jones et al.
4,374,442 A 2/1983 Hein et al.
4,634,133 A * 1/1987 Wercholoz ..... 277/642
4,740,404 A * 4/1988 Otsugu et al. ..... 428/44
4,901,495 A * 2/1990 Gottschling ..... 52/396.05
6,460,214 B1 * 10/2002 Chang ..... 14/73.1

FOREIGN PATENT DOCUMENTS

DE 38 14 421 C1 11/1989

* cited by examiner

*Primary Examiner*—Robert Canfield
*Assistant Examiner*—Christine T. Cajilig
(74) *Attorney, Agent, or Firm*—The Webb Law Firm

(57) ABSTRACT

A multi-seal waterproof expansion joint for roadways includes an L-shaped load-bearing member mounted to each end of adjacent roadway sections. The lower surface of the horizontal leg of each load-bearing member has a shaped end to receive an insert to provide a retention cavity accessible by an elongated groove. A primary seal has opposite sides captured in the cavities. Vertical leg of a support member is mounted to each of the load-bearing members. Horizontal legs of the support members are spaced from the horizontal leg of its respective load-bearing member to provide a pair of spaced chambers. A secondary seal has opposite sides captured in the chambers. Movement of the roadway sections due to temperature changes compresses and stretches the primary seal while the sides of the secondary seal slide in their respective chamber. The primary seal can be inserted and/or removed from above or below the roadway.

23 Claims, 6 Drawing Sheets

5

MULTI-SEAL WATERPROOF EXPANSION JOINT FOR ROADWAYS

BACKGROUND OF THE INVENTION

1. Field of the Invention

This invention relates to a waterproof expansion joint for roadways and, more particularly, to a load-carrying, multi-seal expansion joint for sealing the gap between sections of roadways, e.g., bridge decks, and for inserting and removing the primary seal from above, and the primary and secondary seals from below, the bridge deck.

2. Description of the Technology

Expansion joints for roadways are provided to cover gaps or separations between sections of roadway, e.g., bridge decks, floors of parking lots, and ramps connected thereto. Expansion joints should be sufficiently wide to allow for the roadway sections to expand as the surrounding temperature increases, i.e., the joint should be wide enough such that minimal, if any, compressive forces are applied to the road sections. In instances when excessive compressive forces are applied, the road buckles and the road sections need to be repaired. When the temperature of the surrounding temperature decreases, the joint should not be excessively wide to make the roadway unusable, e.g., causing damage to the vehicles moving over the expansion joint. In addition to the joint providing adequate expansion and contraction, the joint has to (1) have structural stability to carry the vehicles moving on the roadway, (2) have minimal road surface variation to minimize road bumps, (3) have adequate sealing to prevent water from moving between the roadway sections and damaging the support structure for the roadway, e.g., steel bridge structures, (4) be easy to repair, (5) have structural members that have a life expectancy of at least 75 years, and (6) have seals that have a life expectancy of at least 25 years.

There are presently available joint expansion designs, e.g., disclosed in U.S. Pat. Nos. 3,520,236; 3,699,853; 3,797,188, 4,295,315; and 4,374,442, and German Patent No. DE 38 14 421 C1; however, the expansion joint designs presently available do not adequately meet all of the requirements discussed above. Therefore, as can be appreciated by those skilled in the art, it would be advantageous to provide an expansion joint for roadways that provides adequate expansion and contraction of the road sections, provides adequate structural stability, provides adequate sealing, is easy to repair, and has an acceptable life expectancy.

SUMMARY OF THE INVENTION

This invention relates to a member of an expansion joint, the member includes an elongated load-bearing member having a first leg joined to a second leg, with the second leg having a cutout end portion, an elongated insert mountable on the cutout end portion to form an elongated cavity at the cutout end portion of the second leg of the load-bearing member, an elongated groove facing away from the first leg of the load-bearing member to provide external access to the cavity, and an elongated support member having a first leg joined to a second leg, the first leg of the support member mountable on the first leg of the load-bearing member, with the second leg of the support member spaced from the second leg of the load-bearing member to provide a space therebetween, wherein with the insert mounted on the cutout portion of the second leg of the load-bearing member and the first leg of the support member mounted on the first leg of the load-carrying member, the space is converted to a chamber having an elongated opening facing away from the first leg of the load-bearing member to provide external access to the chamber.

The invention further relates to a road expansion joint mounted in a space between ends of first and second roadway sections. The road expansion joint includes a first load-bearing member mounted to the end of the first section, the first load-bearing member having a retention cavity or groove, and a second load-bearing member mounted to the end of the second section. The second load-bearing member is spaced from the first load-bearing member and has a retention cavity or groove with the retention cavity of the second load-bearing member facing the retention cavity of the first load-bearing member. A first support member mounts the first load-bearing member and with the first load-bearing member provides a first chamber having an elongated opening. The second support member mounts the second load-bearing member and, with the second load-bearing member, provides a second chamber having an elongated opening, with the elongated openings of the first and second chambers facing one another. An elongated first seal has a first side and an opposite second side, with the first side of the first seal in the retention cavity of the first load-bearing member and the second side of the first seal in the retention cavity of the second load-bearing member. An elongated second seal has a first side and a second side, with the first side of the second seal in the first chamber and the second side of the second seal in the second chamber, wherein as the first and second load-bearing members move away from one another the first seal is put under tension and the ends of the second seal slid in their respective chamber and, as the first and second load-bearing members move toward one another, the first seal is put in compression, e.g., forms convolutions, and the ends of the second seal slid in their respective chamber.

The invention further relates to a method of replacing a primary seal of a waterproof expansion joint for roadways. The method includes, among other things, pulling a cord out of a retention cavity of first and second load-bearing members, removing the primary seal from the cavities and thereafter inserting the ends of replacement primary seal in the cavities. Cords are inserted into the cavities to retain the ends of the primary seal in their respective cavity. The steps of the method can be carried out above and/or below the roadway, e.g., a bridge deck or ramp.

The invention further relates to the replacement of a primary seal and secondary seal of an expansion joint of the type described above. The steps include removing the secondary seal, e.g., by loosening the second support members from their respective load bearing member, followed by removing the primary seal, e.g., by removing the bead and/or the insert securing the end of the primary seal in its respective cavity. The primary seal is replaced followed by replacing or inserting the removed secondary seal. The method is practiced under the roadway, e.g., bridge deck or ramp, while the traffic on the roadway continues.

DESCRIPTION OF THE PREFERRED EMBODIMENTS

Figure 1:
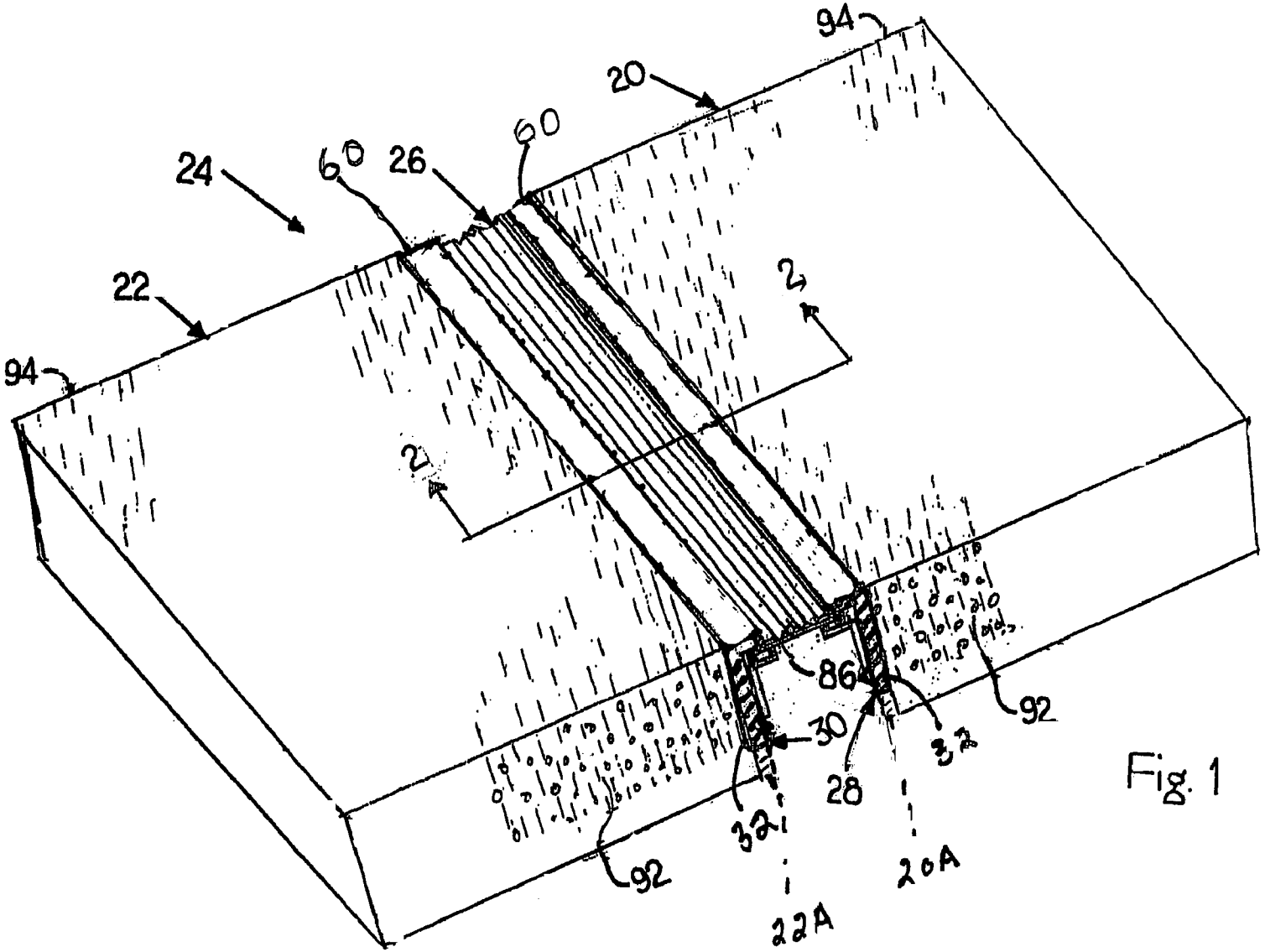
FIG. 1 is a partial orthogonal view of a roadway having a waterproof expansion joint incorporating features of the invention.

As used herein, spatial or directional terms, such as "inner", "outer", "left", "right", "up", "down", "horizontal", "vertical", and the like, relate to the invention as it is shown in the drawing figures. However, it is to be understood that the invention can assume various alternative orientations and, accordingly, such terms are not to be considered as limiting. Further, all numbers expressing dimensions, physical characteristics, and so forth, used in the specification and claims are to be understood as being modified in all instances by the term "about". Accordingly, unless indicated to the contrary, the numerical values set forth in the following specification and claims can vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques. Moreover, all ranges disclosed herein are to be understood to encompass any and all subranges subsumed therein. For example, a stated range of "1 to 10" should be considered to include any and all subranges between (and inclusive of) the minimum value of 1 and the maximum value of 10; that is, all subranges beginning with a minimum value of 1 or more and ending with a maximum value of 10 or less, e.g., 1 to 6.7, or 3.2 to 8.1, or 5.5 to 10.

Before discussing several non-limiting embodiments of the invention, it is understood that the invention is not limited in its application to the details of the particular non-limiting embodiments shown and discussed herein since the invention is capable of other embodiments. Further, the terminology used herein to discuss the invention is for the purpose of description and is not of limitation. Still further, in the following discussion, unless indicated otherwise, like numbers refer to like elements.

Figure 2:
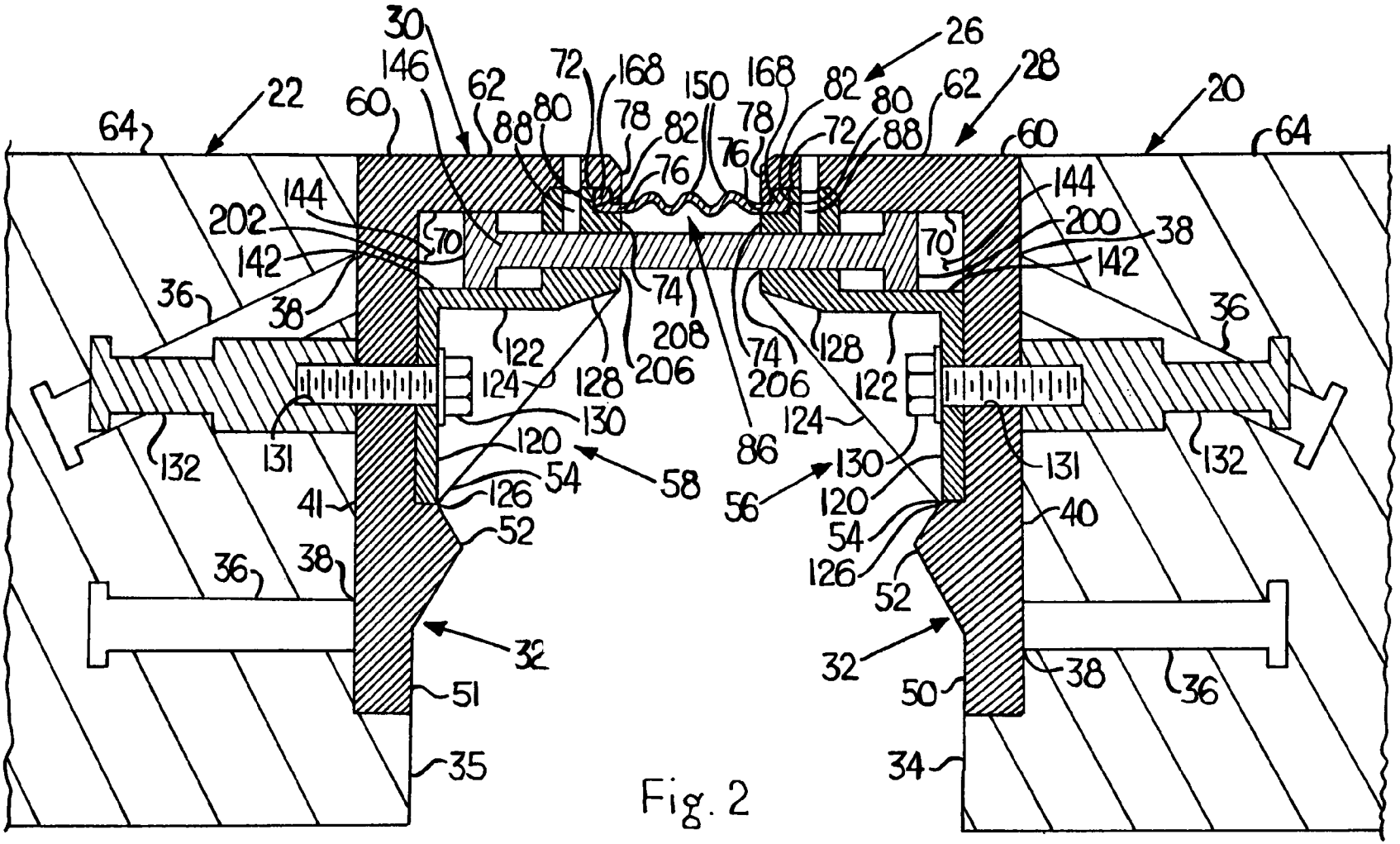
FIG. 2 is a view taken along lines 2-2 of FIG. 1.

With reference to FIG. 1, there is shown two sections 20 and 22 of a roadway 24 joined by an expansion joint sealing assembly 26 incorporating features of the invention. As can be appreciated, the invention is not limited to the roadway, and the roadway can be, but is not limited to, a bridge deck, the floor of a parking garage, a roadway and/or a ramp leading to and/or from a bridge deck, the floor of a parking garage, and/or a roadway. With reference to FIGS. 1 and 2 as needed, the expansion joint assembly 26 of a non-limiting embodiment of the invention includes a pair of generally L-shaped load-carrying members 28 and 30 having a vertical leg 32 securely mounted to ends 34 and 35 of road sections 20 and 22, respectively, by headed studs 36. More particularly, end 38 of the headed studs 36 is welded to inner surfaces 40 and 41 of the leg 32 of the load-carrying members 28 and 30, respectively, and the end of the headed studs 36 embedded in the material of the roadway, e.g., concrete, to secure the load-carrying members 28 and 30 to the ends 34 and 35 of the sections 20 and 22, respectively. The mounting of load-carrying members of seal joint assemblies to the end of adjacent roadway sections is known in the art and no further discussion is deemed necessary. Optionally, concrete can be provided under the load-carrying or load-bearing member as shown in FIG. 2, or the concrete can be absent as shown in phantom as 20A and 22A in FIG. 1.

Outer surfaces 50 and 51 of the legs 32 of the load-carrying members 28 and 30, respectively facing one another, each has a radiused surface portion 52 ending in a ledge 54 for supporting support sections 56 and 58, respectively, discussed in detail below.

Horizontal leg 60 of the load-carrying members 28 and 30 has an outer surface 62 generally flush with roadway surface 64 of the sections 20 and 22, and an inner surface 70. The inner surface 70 has a shaped cutout portion 72 that cooperates with shaped surface of insert member 74 to form an elongated opening 76 extending from surface 78 of the horizontal leg 60 to a cavity 80 for engaging an end 82 or 84 of primary seal 86 in a manner to be discussed below. In FIG. 2, the insert member 74 is shown secured in the cutout portion 72 of the horizontal leg 60 of the load-carrying members 28 and 30, respectively, by a machine screw 88. Although not limiting to the invention, the head of the screw 88 is shown recessed into the body of the insert member 74 to provide a flat surface. As can be appreciated, the head of the screw 88 can be recessed in a hole in the outer surface 62 of the leg 60 of the load-carrying members 28 and 30. In the practice of the invention but not limiting to the invention, it is preferred to have the head of the screw 88 in the body of the insert member 74 to prevent unauthorized removal of the screw and/or loosening of the screw by road vibrations.

Figure 3:
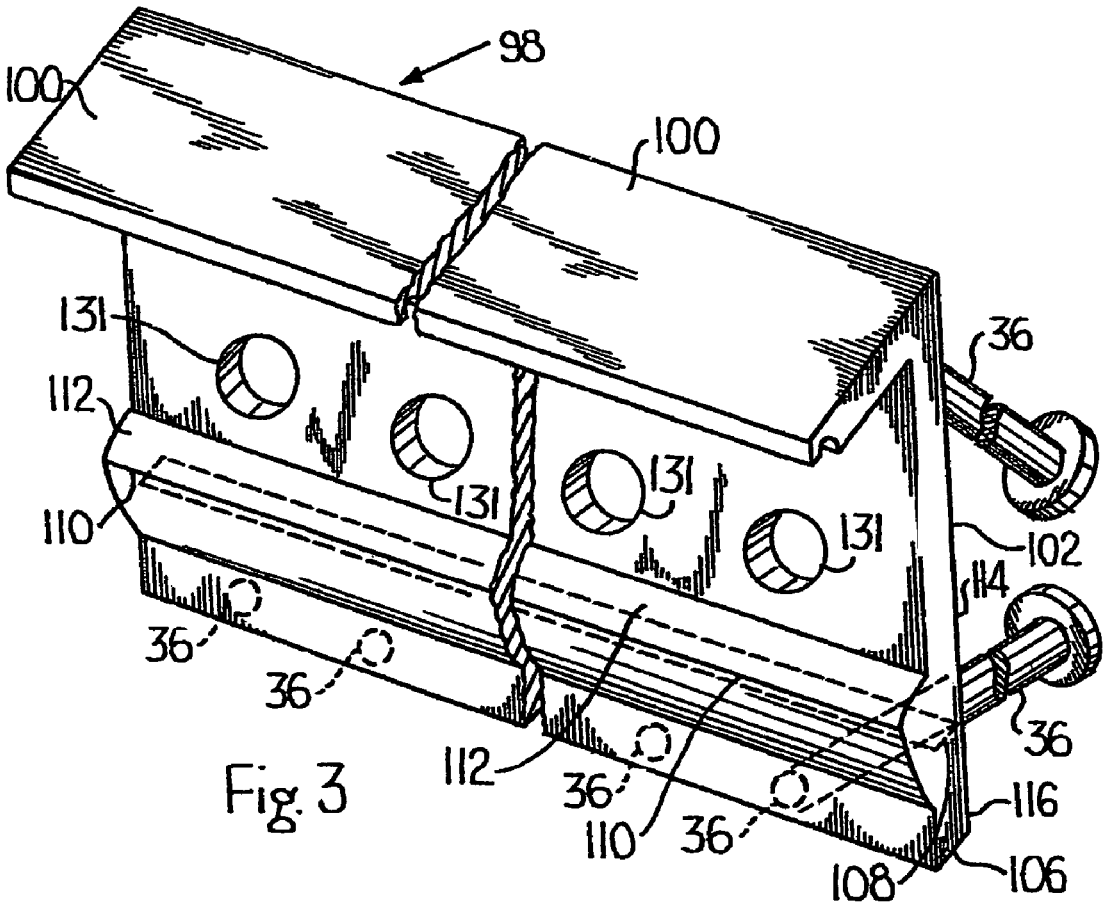
FIG. 3 is an orthogonal view of a load-carrying member of the invention.

With reference to FIGS. 1-3 and not limiting to the invention, each of the L-shaped load-carrying members 28 and 30 preferably has a length to extend across the roadway, e.g., from side 92 to side 94 of the sections 20 and 22 of the roadway 24 (see FIG. 1). The load-carrying members 28 and 30 can be made of any structural material capable of carrying the expected load. Preferably, but not limiting to the invention, the material selected for the load-carrying members should provide a life expectancy of at least 75 years. In the preferred practice of the invention, the load-carrying members are made of steel. Further, as can be appreciated, the load-carrying members can be made of a single section or several sections joined together. For example, with reference to FIG. 2 and not limiting to the invention, the vertical leg 32 and the horizontal leg 60 of the load-carrying members 28 and 30 are shown made of a single piece of steel with the vertical leg 32 having the radiused surface portion 52 and the ledge 54 for supporting the support sections 56 and 58, respectively. As shown in FIG. 3 and not limiting to the invention, L-shaped load support 98 is one piece having horizontal leg 100 and vertical leg section 102. Vertical leg section 106 is welded to the vertical leg section 102 at 108. The vertical leg section 106 provides the radiused portion 110 and ledge 112, which corresponds to the radiused portion 52 and the ledge 54 of the leg 32 shown in FIG. 2.

Each of the vertical leg sections 102 and 106 have a headed stud 36 attached thereto to secure the load-carrying member 98 to the end of its respective roadway section as previously discussed for securing the legs 32 of the load-carrying members 28 and 30 to the roadway sections 20 and 22, respectively.

As can be appreciated, the invention is not limited to the dimensions of the load-carrying members 28 and 30; however, the members 28 and 30 as previously mentioned should have sufficient structural load-bearing capacity to carry the expected load. In the practice of the invention but not limited thereto, the members 28 and 30 are single pieces extending across the roadway 24 from the side 92 to the side 94, i.e., the length of the members 28 and 30 which is the length of the horizontal leg 60 and the vertical leg 32 (see FIG. 1). For a 2-inch (5.08 centimeters ("cm")) expansion joint and not limiting to the invention, the width of the members 28 and 30, which is the width of the horizontal leg 60, is 3 inches (7.62 cm), and the height of the members 28 and 30, which is the height of the vertical leg 32, is 8 inches (20.32 cm). The thickness of the vertical leg 32 is ¾ inch (1.9 cm) with the radiused surface portion 52 having a thickness at its widest point of 1 inch (2.54 cm). The thickness of the horizontal leg 60, except at the cutout portion 72 which is discussed below, is ¾ inch (1.9 cm). For a 3-inch (7.62 cm) expansion joint and not limiting to the invention, the width of the horizontal leg 60 is 4 inches (10.16 cm), and the height of the vertical leg 32 is 8 inches (20.32 cm). The thickness of the vertical leg 32 is ⅞ inch (2.22 cm) with the radiused surface portion 52 having a thickness at its widest point of 1.28 inches (3.35 cm). The thickness of the horizontal leg 60, except at the cutout portion 72 which is discussed below, is ⅞ inch (2.22 cm). For a 4-inch (10.16 cm) expansion joint and not limiting to the invention, the width of the horizontal leg 60 is 5 inches (12.7 cm), and the height of the members 28 and 30, which is the height of the vertical leg 32, is 8 inches (20.32 cm). The thickness of the vertical leg 32 is 1 inch (2.54 cm) with the radiused surface portion 52 having a thickness at its widest point of 1.50 inches (3.81 cm). The thickness of the horizontal leg 60, except at the cutout portion 72 which is discussed below, is 1 inch (2.54 cm).

Figure 4:
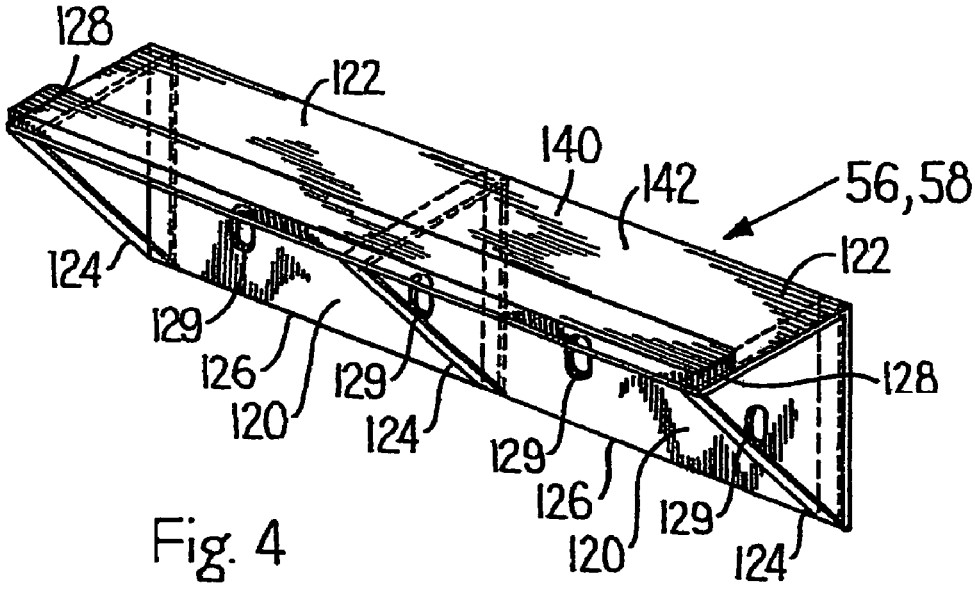
FIG. 4 is an orthogonal view of a support section of the invention.

Referring now to FIGS. 2 and 4, the L-shaped support sections 56 and 58 each have a vertical leg 120 connected to a horizontal leg 122 to provide the legs 120 and 122 with a generally L-shaped cross section. Gusset plates 124 interconnect the legs 120, 122 to provide the support sections 56 and 58 with structural stability. The gusset plates 124 are equally spaced from one another with a gusset plate at each end of the support sections, as shown in FIG. 4. As can be appreciated, the invention is not limited to the length of the support sections or the number of gusset plates or the thickness of the vertical and horizontal legs or the thickness of the gusset plates. In the practice of the invention but not limited thereto, support sections 56 and 58 having a length of about 24 inches (0.61 meters), the vertical leg 120, the horizontal leg 122, except for the end portion 128 which is discussed below, and the gusset plates 124 having a wall thickness of about 0.25 inch (0.635 cm), and a vertical leg having a height of 3 inches (7.62 cm), are acceptable. For a 3-inch (7.62 cm) expansion joint, a horizontal leg having a width of 3.13 inches (7.95 cm) is acceptable. Although the invention is not limited to the material of the support sections 56 and 58, the material should be structurally stable, e.g., made of metal or reinforced plastics. In the practice of the invention although not limiting thereto, the support sections are made of steel. End 126 of the vertical leg 120 is supported on the ledge 54 of the vertical leg 32 of the load-carrying members 28 and 30 (see FIG. 2) and the ledge 112 of the L-shaped load-carrying member 98 (see FIG. 3).

With continued reference to FIG. 4, the vertical leg 120 of the support sections 56, 58 has a plurality of elongated holes 129 used to secure the L-shaped support section 56, 58 on the ledge 54 of the load-carrying members 28 and 30 (see FIG. 2) or ledge 112 of the load-carrying member 98 (see FIG. 3). In the practice of the invention but not limited thereto, an anchor bolt 130 is passed through each of the holes 129 in a support section, e.g., the support section 56, and through threaded holes 131 (clearly shown in FIG. 3 for the member 98) of the vertical leg 32 of the member 28 into a threaded anchor collar 132 embedded in the material of the road sections, e.g., concrete. With the start of the threading of the bolt 130 into the anchor collar 132, the elongated holes 129 allow the end portion 126 of the vertical leg 120 to rest on the radiused surface portion 52 of the vertical leg 32 (FIG. 2) or the radiused surface portion 110 of the vertical leg portion 106 (FIG. 3). As the bolt 130 is threaded further into the collar 132, the end portion 126 of the vertical leg 120 slides up the radiused surface portion and is seated on the ledge 54 (FIG. 2) or the ledge 112 (FIG. 3).

With reference to FIGS. 2 and 4, the end portion 128 of the horizontal leg 122 of the support sections 56 and 58 is thicker to provide upper surface 140 (see FIG. 4) of the horizontal leg 122 with a grooved surface 142, e.g., having a depth of 0.25 inch (0.635 cm). The grooved surface 142 of each of the support sections 56 and 58 is spaced 0.50 inch (1.27 cm) from the inner surface 70 of the horizontal leg 60 of the load-carrying members 28 and 30 to provide a chamber 144 for capturing end portions of a secondary seal 146 in a manner discussed below.

The discussion will now be directed to non-limiting embodiments of the primary seal 86 and the secondary seal 146 of the invention which function in a manner discussed below to prevent water and road debris, e.g., but not limited to deicing chemicals, from moving between the road sections 20 and 22, e.g., but not limiting the invention, to the underlying bridge superstructure. With reference to FIG. 2, the primary seal 86, which prevents water and/or road debris from moving between the load-carrying members 28 and 30, has convolutions 150, which allow the primary seal to expand in the wintertime and contract in the summertime without the primary seal extending above the road surface. Although not limiting to the invention, the primary seal 86 preferably has memory to maintain the primary seal below road surface during the contraction of the sections 20 and 22 during cold weather, e.g., winter months, has at least 400% elongation, has a high resistance to ultraviolet (UV) rays, hydrolysis, and fungus, acceptable low-temperature flexibility with durability, has continuous extrusion to provide a length sufficient to span any present deck width, and has an acceptable life expectancy, e.g., at least 25 years. Materials that can be used in the practice of the invention, but not limited thereto, include an ether-containing material, ester-containing material, and combinations thereof, such as, but not limiting to the invention, a urethane. The material can be a polymeric material, such as a polyester-containing material, such as a polyurethane. Other suitable materials include plastics, such as thermoplastic plastics or thermoset plastics, examples of which include acrylic, vinyl, or styrene-containing materials or polymers. In a non-limiting embodiment of the invention, the primary seal can be a urethane of the types sold by BASF under the mark ELASTOLLAN® 1100 series and, in particular but not limiting the invention thereto, under the mark ELASTOLLAN® 1175A-10W. The primary seal shown in FIG. 2 has convolutions; however, as can now be appreciated, the primary seal can be used without convolutions depending on the amount of roadway expansion during hot weather, e.g., summer months.

Figure 5A:
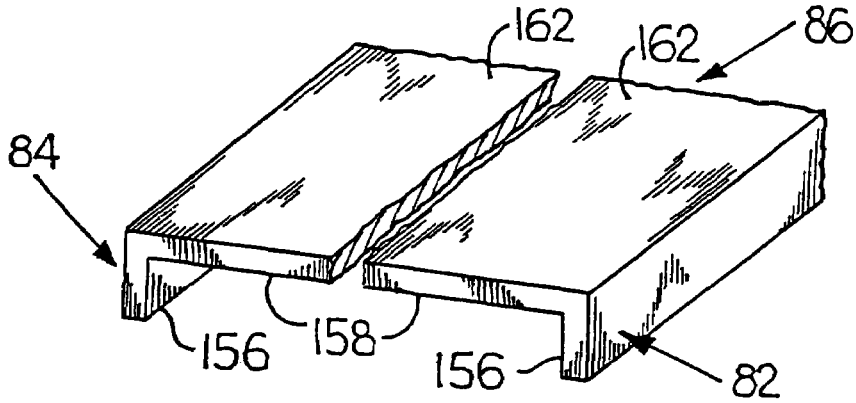
FIG. 5 includes FIGS. 5A and 5B which are sectionalized perspective views of primary seals incorporating features of the invention.
Figure 5B:
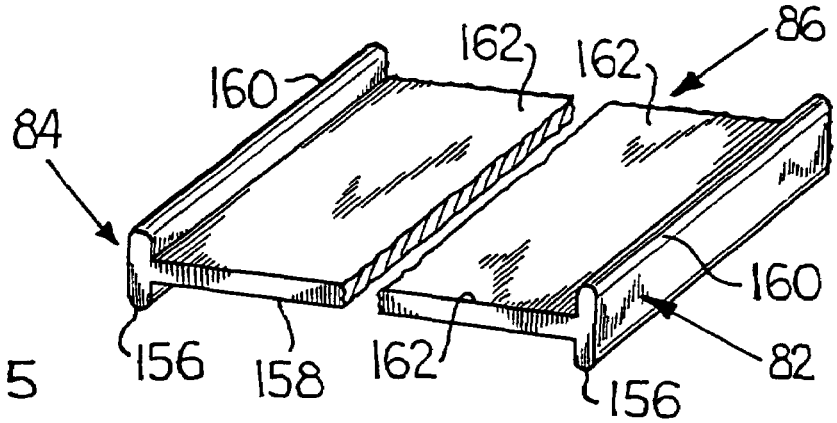

With reference to FIG. 5, the primary seal 86 can have a lobe 156 at each end 82 and 84, the lobe 156 extending from one major surface 158 as shown in FIG. 5A, or can have a lobe 156 and 160 at each end 82 and 84 extending from each opposed major surface 158 and 162, respectively, as shown in FIG. 5B. The lobe 156 (FIG. 5A) or the lobes 156 and 160 (FIG. 5B) of the primary seal are captured in the cavity 80 (see FIG. 2) formed by the insert member 74 and the shaped cutout portion 72 on the inner surface 70 of the horizontal leg 60 of the load-carrying members 28 and 30, as discussed above.

The ends of the primary seal 86 can be captured in the cavity 80 formed by the shaped cutout portion 72 of the horizontal leg 60 and the insert member 74 in any convenient manner. For example but not limiting to the invention, an end of the primary seal 86 can be held against the shaped cutout portion 72 of the horizontal leg 60 of one of the load-carrying members 28 or 30, and the insert member 74 attached to the horizontal leg 60 of the load-carrying member 28 or 30 by the screw 88, as previously discussed. In this manner, the end of the primary seal 86 is captured in the cavity 80 with the primary seal 86 extending out of the elongated opening 76 as previously discussed (see FIG. 6). This technique is preferred when the primary seal 86 has the lobes 156 and 160 extending from each surface 158 and 162, as shown in FIG. 5B. As can be appreciated, the invention contemplates securing the ends of the primary seal 86 in the cavity 80 from above the roadway and/or from below the roadway, e.g., a bridge deck and/or ramp. More particularly, in a non-limiting embodiment of the invention, when the primary seal 86 is installed from above the roadway, the screws 88 are moved through the leg 60 of the load-carrying members 28, 30 into the inserts 74. The inserts 74 are spaced from their respective ends of the leg 60 of the load-carrying members to pull the lobes of the primary seal 86 through their respective cavity 80. Thereafter, the screws 88 are tightened to capture the ends of the primary seal 86 in their respective cavity 80. In a non-limiting embodiment of the invention, when the primary seal 86 is installed from below the roadway, the screws 88 pass through the inserts 74 into their respective end of the leg 60 of the load-carrying members 28, 30. As before, the insert 74 is spaced from its respective leg 60 to allow for inserting the ends of the primary seal 86 into their respective groove 80. Thereafter, the screws 88 are tightened to secure the ends of the primary seal 86 in their respective cavity 80.

Figure 6:
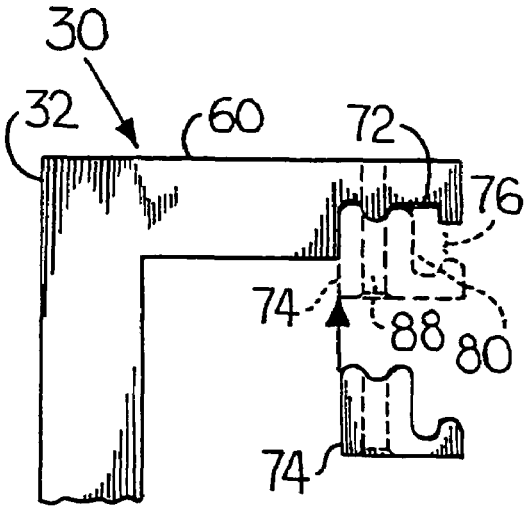
FIG. 6 is a partial elevated side view of a load-carrying member and a perspective view of an insert member, each incorporating features of the invention.
Figure 7:
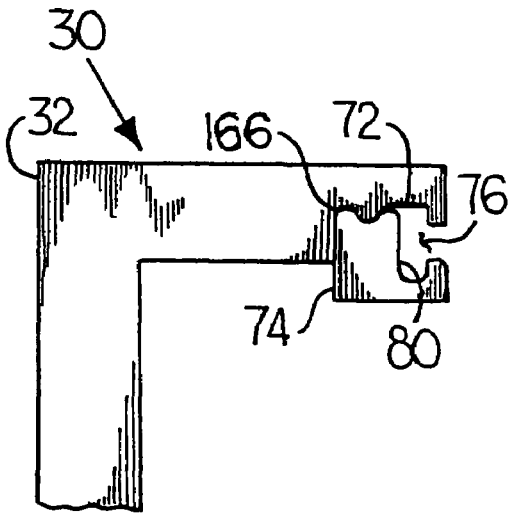
FIG. 7 is a partial elevated side view of a load-carrying member having an insert member mounted thereon in accordance with the invention.

Another non-limiting embodiment of the invention to install the primary seal 86 is to secure the insert member 74 to the shaped cutout portion 72 by the screw 88 as shown in FIGS. 2 and 6, or as shown in FIG. 7, e.g., by welding the insert member 74 at 166 to the cutout portion 72. Thereafter, the primary seal 86 having lobes 156 extending only from one major surface 158 is inserted into the cavity 80, e.g., at the side 92 of the roadway 24 (see FIG. 1), and pulled through the cavity 80 of each load-carrying member 28 and 30 from the side 92 to the side 94. In a non-limiting embodiment of the invention, to secure the ends 82 and 84 of the primary seal 86 in their respective cavity 80 from above the roadway, an elongated bead (or cord) 168 (see FIG. 2) is forced into the elongated opening 76 between the surface 162 of the primary seal 86 and adjacent wall of the opening 76 to capture the ends of the primary seal in their respective cavity. In a non-limiting embodiment of the invention, to secure the ends 82 and 84 of the primary seal 86 in their respective cavity 80 from below the roadway, an elongated bead (or cord) 168 (see FIG. 2) is forced into the elongated opening 76 between the surface 162 of the primary seal 86 and adjacent wall of the opening 76 to capture the ends 82, 84 of the primary seal 86 in their respective cavity.

Figure 8:
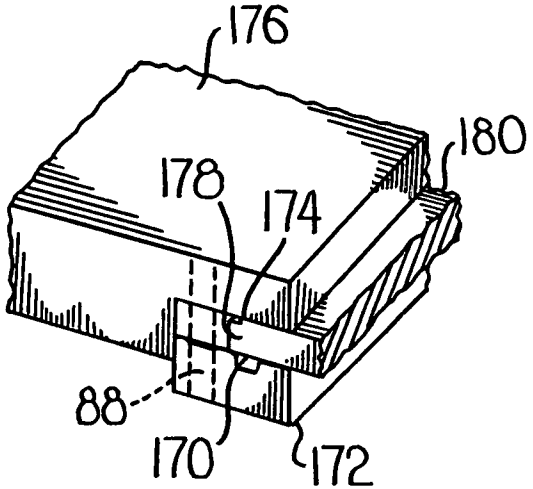
FIG. 8 is a perspective view of a non-limiting embodiment of the invention for engaging the end of a primary seal in accordance with the teachings of the invention.

In another non-limiting embodiment of the invention, a primary seal 180 does not have any lobes extending from a major surface 170, i.e., the end portion 178 of the primary seal 180 is flat as shown in FIG. 8 for end 178 of the primary seal 180. As can be appreciated, the invention is not limited to the manner in which the primary seal is engaged by the horizontal member of the load-carrying member. For example and with reference to FIG. 8, the surface 170 of insert member 172 and surface 174 of horizontal leg 176 of an L-shaped load-carrying member (not shown) each has a rough surface, e.g., but not limiting to the invention, spaced ridges to engage end 178 of the primary seal 180. The surface 170 of the insert member 172 and the surface 174 of the horizontal leg 176 are sized to apply pressure to the end 178 of the primary seal 180 to maintain the end of the primary seal between the surfaces 170 and 174 as the primary seal expands. The insert member 172 is secured to the horizontal leg 176 in any convenient manner, e.g., by a screw as previously discussed.

The primary seal 86 can be removed from the cavity in the reverse order in which it was inserted into and/or secured in the cavity 80. In the practice of the invention but not limiting thereto, it is preferred to use a primary seal having the lobes 156 extending from only one major surface, e.g., the major surface 158 as shown in FIG. 5A because the primary seal can more easily be pulled through the cavity 80, and the primary seal 86 and the bead inserted from above or below the roadway surface. As can be appreciated, an advantage to removing and inserting the primary seal from below the roadway surface is that there is no interruption, e.g., stopping, of traffic to remove the old, and install the new, primary seal.

In the practice of the invention but not limiting the invention thereto, the bead is made of an ether-containing material of the type discussed above for the primary seal. As can be appreciated but not limiting to the invention, the bead can be made of a material selected from the same group of materials discussed above for the primary seal, and can be made of the same material as, or different material than, the primary seal.

As can be appreciated, the dimensions of the end portions 82 and 84 of the primary seal 86 and the cord 168, and the durometer of the cord 168 and primary seal are selected such that the cord 168 and the primary seal can be compressed as the cord 168 passes through the opening 76 into the cavity 80, and the cord 168 seated in the cavity 80 applies sufficient pressure to maintain its respective end 82 or 84 of the primary seal 86 in the cavity 80. For example and not limiting to the invention, for an elongated opening 76 having a height of about 0.25 inch (0.635 cm), a primary seal 86 having a thickness of 0.125 inch (0.318 cm) between the surfaces 158 and 162, and an end 82, 84 having a radiused lobe 156 having a thickness of 0.25 inch (0.635 cm) used with a cord 168 having a diameter of 0.25 inch (0.635 cm) and made of urethane of the type sold by BASF under the mark ELASTOLLAN® 1175A-10W is sufficient to maintain the primary seal 86 in the cavity 80. Preferably, the length of the primary seal 86 is the length of the width of the bridge deck or roadway. Having a one-piece primary seal reduces leakage of water through the seal to the structure of the bridge, ramp or roadway. The width of the primary seal should be sufficient to accommodate the greatest expected expansion of the roadway sections 20 and 22.

The discussion will now be directed to the secondary seal 146. As discussed above, the primary seal 86 prevents water and/or road debris from moving between the load-carrying members 28 and 30. The secondary seal 146 prevents water and/or road debris from the bridge structure in the event the primary seal has leakage. In addition, the secondary seal 146 provides a support to limit the downward displacement of the primary seal 86 due to the weight of the water and road debris on the primary seal 86. Keeping the primary seal slightly below the road surface allows for removal of the water and road debris on the primary seal by the wind and vehicles moving over the expansion joint.

The secondary seal 146, as shown in FIG. 2 in cross section, has a barbell or dog bone appearance having headed ends 200 and 202 captured in the chamber 144 formed by the horizontal leg 60 of the load-carrying members 28 and 30 and the horizontal leg 122 of the L-shaped support sections 56 and 58, respectively, as previously discussed. The chamber 144 has a width sufficient to pass body 208 of the secondary seal 146 therethrough and small enough to capture the ends 200 and 202 in their respective chamber 144. In this manner, the expansion joint can slide along the body of the secondary seal as the sections 20 and 22 of the roadway 24 expands and contracts. A slot 206 is formed by the end portion 128 of the horizontal leg 122 of the support sections 56 and 58 and the surface of the insert member 74. For example but not limiting to the invention, the width of the secondary seal as measured between the ends 200 and 202 is 6.95 inches (17.65 cm), the thickness of the body 208 of the secondary seal 146 is 0.495 inch (1.25 cm), the thickness of the ends 200 and 202 of the secondary seal 146 is 1.25 inches (3.175 cm), and the opening of the slot 206 is 0.50 inch (1.26 cm). The secondary seal 146 is preferably in a continuous length; however, because the primary seal 86 is continuous, the secondary seal 146 can be made up of sections having the ends joined together. Preferably, the ends of the secondary seal sections overlap and are sealed to prevent water flowing through the secondary seal to the superstructure.

Figure 9:
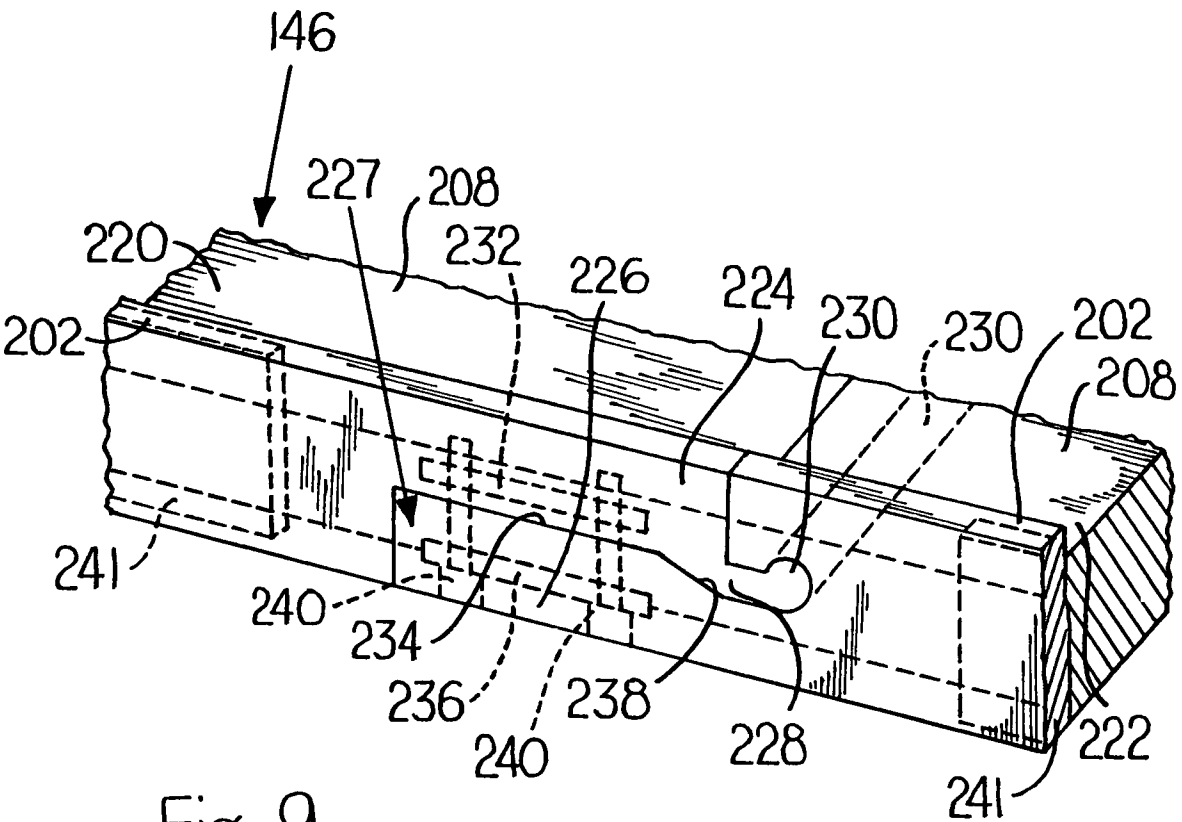
FIG. 9 is a fragmented orthogonal elevated side view of an arrangement incorporating features of the invention for joining ends of adjacent sections of a secondary seal together in accordance with the teachings of the invention.

A non-limiting embodiment of the invention to join ends of secondary seal sections is shown in FIG. 9. With reference to FIG. 9 there is shown secondary seal sections 220 and 222. End 224 of section 220 is similar to end (not shown) of the secondary seal section 222, and end 226 is similar to end (not shown) of secondary seal section 220. In this manner, adjacent ends of the secondary seal sections 220, 222 can be joined to provide a secondary seal extending from the side 92 to the side 94 of the roadway 24. The end 224 of the secondary seal section 220 includes a step down portion 227 terminating in a finger 228 having a rounded end 230. The finger 228 extends from the barbell end 202 to the barbell end 200 (not shown in FIG. 9). A rigid plate, e.g., a metal plate 232, is embedded in the barbell ends 202 and 200 (not shown in FIG. 9) at the step down portion 227 of the end 224. The barbell ends 202 and 200 (not shown in FIG. 9) at the end 226 has a step down portion 234 and a rigid plate 236. The step down portion 234 of the section 222 has an adjacent groove 238 sized to receive the finger 228 with the rounded end in the groove 238 when the step down portions 227 and 234 of the sections 220 and 222, respectively, overlap one another. The groove 238 extends from the barbell end 202 to the barbell end 200 (not shown in FIG. 9). Machine screws 240 pass through the metal plates 232 and 236 of the sections 220 and 222 to secure the ends of adjacent secondary seal sections together.

Optionally and not limiting to the invention, rigid plates, e.g., metal plates 241, can be provided in the barbell ends 200 and 202, as shown in the barbell end in FIG. 9, to prevent squeezing of the barbell ends 200, 202 out of their respective slot 206 as a result of, among other things, water and road debris forcing the primary seal downward and torsional and/or tensile forces exerted on the secondary seal 146 during a seismic event, e.g. but not limited to an earthquake. In addition, but not limiting to the invention, the secondary seal 146 of the invention provides the expansion joint of the invention with a design to accommodate earthquake movement and remain functional, resist earthquake forces, and help provide damping. For example but not limiting to the invention, polyurethane of the type sold by C.U.E., Inc of Cranberry Township, Pa., under Compound Numbers PO-670, PO-650, and PO-652, having a Shore Durometer in the range of 70 A to 93 A measured according to ASTM D2240-64T, can be used in the practice of the invention. More particularly, a secondary seal made of the above-mentioned polyurethane materials having a thickness of 0.5 inch (1.27 cm), a length of 40 feet (12.2 meters), and covering a divided space of 6 inches (15.2 cm), i.e., the distance between the horizontal legs 122 of the L-shaped support sections 56 and 58, is expected to withstand a 4 degree clockwise and a 4 degree counterclockwise twist around the longitudinal center of the expansion joint, i.e., the center line between the sides of the sections 20 and 22 of the roadway 24 without tearing or rupturing the secondary seal. As can be appreciated, for a secondary seal having a 40 foot (12.2 meters) length, e.g., as measured between sides 92 and 94 of the sections 20 and 22 (see FIG. 1), the secondary seal at the sides of the sections 20 and 22 of the roadway 24 has a displacement of 18 inches (0.5 meter) in the clockwise direction and 18 inches (0.5 meter) in the counterclockwise direction.

The invention is not limited to the durometer of the secondary seal. In geographic areas where there is no history of seismic events, the durometer can be decreased, i.e., the secondary seal can be softer because of the low probability of torsional twist of the secondary seal. In geographic areas where there is a history of severe seismic events, the durometer of the secondary seal should be increased to resist the torsional twist of the secondary seal.

Further, in geographic areas where seismic events occur, it is preferred to use a material for the secondary seal that has dampening properties, e.g., but not limiting the invention thereto, urethane, to prevent the vibrations of one roadway section being transmitted to the adjacent roadway section.

The secondary seal 146 is positioned between the horizontal leg 60 of the load-carrying members 28, 30, and the horizontal leg 122 of the L-shaped support sections 56 and 58 in any convenient manner. For example and not limiting to the invention, bolts 130 are passed through the holes 129 of a support section 56 or 58 and the holes 131 of one of the load-carrying members 28 or 30 into the threaded anchor collars 132. Each of the barbell ends 200 and 202 of a secondary seal section 220, 222 is positioned on one of the horizontal legs 122 with an end of the secondary seal section overhanging the end of the support section. After the bolts 130 are completely threaded, a secondary seal section is joined to the overhanging end of the secondary seal section recently secured in position. The process is repeated until a secondary seal extends across the roadway from side 92 to side 94. The width of the secondary seal is not limiting to the invention; however, the width of the secondary seal and the chambers are sized to accommodate the smallest expected contraction distance and largest expected expansion distance for the roadway sections 20 and 22.

In a non-limiting embodiment of the invention, the secondary seal 146 and/or sections 220, 222 of the secondary seal 146 are removed in the reverse order in which they were installed. As can now be appreciated, the primary seal 86 and the secondary seal 146 can be installed and/or replaced, and/or the sections 220, 222 of the secondary seal 146 can be replaced from below the roadway without stopping or interrupting traffic.

As can be appreciated, the invention is not limited to the material of the secondary seal, and any materials that provide the properties of the secondary seal discussed above can be used in the practice of the invention for the secondary seal. Materials that can be used in the practice of the invention include, but are not limited to, an ester-containing material, such as a urethane, a polymeric material, such as a polyester-containing material, such as a polyurethane. Other suitable materials include plastics, such as thermoplastic plastics or thermoset plastics, examples of which include acrylic, vinyl, or styrene-containing materials or polymers. Further, as can be appreciated, the primary seal and the secondary seal can be made of the same or different materials.

Figure 10:
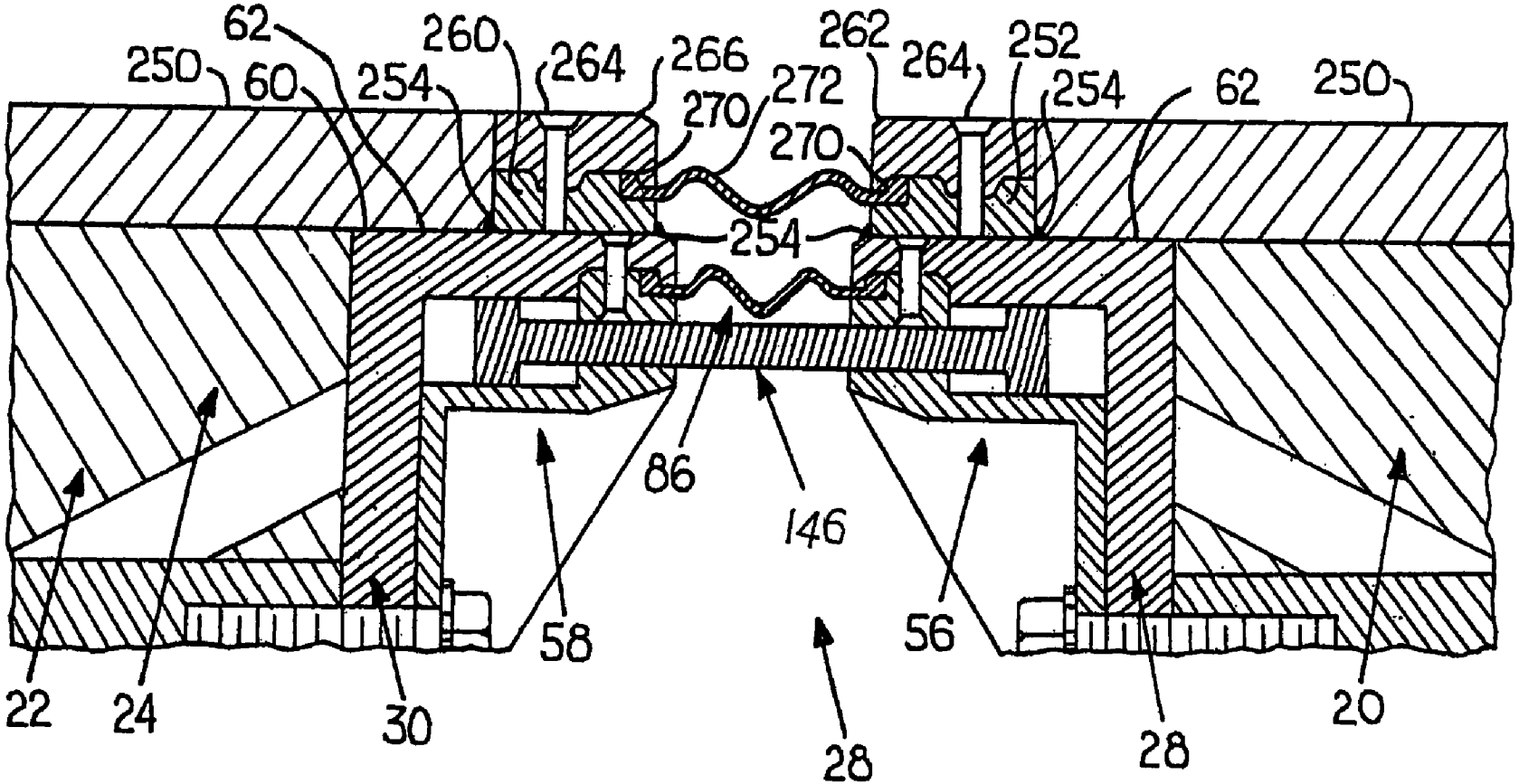
FIG. 10 is a view similar to the view of FIG. 2 showing an added road covering over the roadway and an additional seal incorporating features of the invention.

With reference to FIG. 10 there is shown a non-limiting embodiment of the invention to cover a previous concreted roadway, e.g., the roadway 24 with a covering, e.g., asphalt. An insert member 252 is welded at 254 to the outer surface 62 of the horizontal member 60 of the load-carrying member 28, and an insert 260 is welded at 254 to the outer surface 62 of the horizontal member 60 of the load-carrying member 30. A top insert member 262 is secured to the insert member 252 by a screw 264, and a top insert member 266 is secured to the insert member 260 by a screw 264. The insert members 252 and 262 and the insert members 260 and 266 provide cavity 270 to capture ends of additional seal 272 in similar manner as the insert 74 and cutout portion 72 of the horizontal leg 60 of the load-carrying members 28 and 30 formed the cavity 80 to capture the ends of the primary seal as shown in FIG. 2. As can be appreciated, the additional seal 272 can made of the same material as the primary seal 86 or from a different material.

As can be appreciated, the invention is not limited to the non-limiting embodiments discussed above, and the non-limiting embodiments are present for purposes of illustration and not of limitation.

What is claimed is:

1. A road expansion joint mounted in a space between vertical faces of first and second concrete roadway sections, the joint comprising:

a first load-bearing member mounted to the vertical face of the first roadway section, the first load-bearing member having a retention cavity having an opening to provide access to the interior of retention cavity;

a second load-bearing member mounted to the vertical face of the second roadway section, the second load-bearing member spaced from the first load-bearing member, the second load-bearing member having a retention cavity having an opening to provide access to the interior of the retention cavity of the second load-bearing member with the opening of the retention cavity of the second load-bearing member facing and spaced from the opening of the retention cavity of the first load-bearing member;

first and second support members, the first support member securely mounted to the first load-bearing member with the first load-bearing member and the first support member in a fixed relationship to one another to provide a first chamber having an elongated opening to provide access to the interior of the first chamber, the second support member securely mounted to the second load-bearing member with the second load-bearing member and the second support member in a fixed relationship to one another to provide a second chamber having an elongated opening to provide access to the interior of the second chamber, with the elongated openings of the first and second chambers facing one another;

an elongated first seal having a first side and an opposite second side, with the first side of the first seal in the retention cavity of the first load-bearing member and the first seal extending out of the opening of the retention cavity of the first load-bearing member and the second side of the first seal in the retention cavity of the second load-bearing member and the first seal extending out of the opening of the retention cavity of the second-load bearing member, wherein the first seal is recessed below the roadway over which traffic is expected to move; and an elongated second seal having a first side and a second side, with the first side of the second seal in the first chamber and the second seal extending out of the opening of the first chamber and the second side of the second seal in the second chamber and the second seal extending out of the second chamber, wherein as the first and second load-bearing members move away from one another, the first seal is put under tension and the ends of the second seal slide in their respective chamber and portions of the second seal move out of their respective chamber and, as the first and second load-bearing members move toward one another, the first seal compresses and the ends of the second seal slide in their respective chamber and portions of the second seal move into their respective chamber, wherein the first and second seals are not secured together and move independent of one another, and with the sides of secondary seal removed from their respective chamber the openings of the retention cavities of the first and second load-bearing members are accessible from above and below the expansion joint, and with sides of the primary seal in their respective retention cavities, the openings of the chambers are accessible from below the expansion joint.

2. The expansion joint according to claim 1, wherein the elongated first seal has a first major surface and an opposite second major surface, with the second major surface facing the elongated second seal, and the first and second sides of the first seal have lobes extending from the second major surface.

3. The expansion joint according to claim 2, wherein the lobe at each of the first and second sides of the first seal extends along the length of the second surface of the first seal, and further including a lobe at each of the first and second sides of the first seal and extending away from the first major surface, the lobes extending from the first and second major surfaces capturing the first and second sides of the first seal in their respective one of the retention cavities.

4. The expansion joint according to claim 2, wherein the lobe at each of the first and second sides of the first seal extends along the length of the second surface of the first seal, and the first major surface at the first and second sides of the first seal has a surface portion selected from a flat surface portion and a surface portion having a groove, and further comprising a cord in the retention cavity of each load-bearing member, the cord engaging surface portions of its respective one of the retention cavities and the surface portion of the first major surface to capture the first and second sides of the first seal in their respective one of the retention cavities.

5. The expansion joint according to claim 1, wherein interior walls of the retention cavity frictionally engage the side of the first seal in the retention cavities.

6. The expansion joint according to claim 1, wherein the elongated second seal in cross section has a generally barbell shape with the enlarged first and second sides capturing the first and second sides in their respective one of the chambers.

7. The expansion joint according to claim 6, wherein the second elongated seal includes a plurality of sections, with each section having a first side and an opposite second side, with the first side and second side of adjacent sections joined together.

8. The expansion joint according to claim 7, wherein the first side of the sections of the second seal have an elongated cavity extending between the barbell-shaped sides of the section, and the second side of the sections of the second seal has an elongated tab extending between the barbell sides of the section, wherein the cavity and the tab are sized for the tab of one section to fit into the cavity of another section.

9. The expansion joint according to claim 8, wherein a portion of the barbell side at the first side of the sections and a portion of the barbell side at the second side of the sections are shaped to overlap when the tab of one of the sections is in the cavity of the adjacent section, and further comprising fastening members to secure the barbell sides of adjacent members together.

10. The expansion joint according to claim 6, further comprising a rigid elongated member in each of the enlarged first and second sides to resist the barbell sides from moving out of their respective one of the chambers.

11. The expansion joint according to claim 1, wherein the first load-bearing member is an elongated first load-bearing member and the cavity of the first load-bearing member is a first elongated cavity and the opening of the cavity of the first load-bearing member is an elongated opening, the first load-bearing member having an L-shaped cross section comprises a first leg joined to a second leg with the first leg mounted to the vertical surface of the first roadway section and the second leg having a cutout end portion, and an elongated insert mountable on the cutout end portion to form the first retention cavity to receive the first side of the first seal with the elongated opening of the first retention cavity facing the second load-bearing member with the first seal extending out of the opening of the first elongated cavity, and wherein the first support member is an elongated first support member having an L-shaped cross section comprising a first leg joined to a second leg, the first leg of the support member mounted on the first leg of the first load-bearing member and secured thereto by at least one fastener passing through the first leg of the first support member and the first leg of the first load-bearing support member into the first section of the concrete roadway.

12. The expansion joint according to claim 11, wherein the first leg of the first elongated load-bearing member has a raised radiused surface portion to provide a support ledge for an end of the first leg of the first elongated support member, the support ledge facing the second leg of the first load-bearing member, the first leg of the first elongated load-bearing member having one or more threaded holes and the first leg of the first elongated support member having one or more slotted holes aligned with the one or more holes of the first leg of the elongated load-bearing member, and wherein the holes of the first leg of the first elongated load-bearing member are circular having a predetermined area and the holes of the first leg of the elongated support member have a predetermined area greater than the predetermined area of the holes of the first leg of the first load-bearing member.

13. The expansion joint according to claim 12, wherein the first elongated support member has two or more spaced gusset plates joining the first and second legs of the first elongated support member.

14. The expansion joint according to claim 13, wherein the elongated insert is secured to the second leg of the first load-bearing member by a mechanical fastener, or by welding, or by adhesive.

15. The expansion joint according to claim 11, wherein the elongated first seal has a first major surface and an opposite second major surface with the second major surface facing the elongated second seal, and the first and second sides of the first seal have lobes extending from the second major surface.

16. The expansion joint according to claim 15, wherein the elongated second seal in cross section has a generally barbell shape having an enlarged first side opposite to an enlarged second side, with the enlarged first and second sides capturing the enlarged first and second sides in their respective one of the chambers.

17. The expansion joint according to claim 11, wherein the elongated second seal in cross section has a generally barbell shape having an enlarged first side opposite to an enlarged second side, with the enlarged first and second sides capturing the enlarged first and second sides in their respective one of the chambers, and the second elongated seal includes a plurality of sections with each section having a first side and an opposite second side with the first side and second side of adjacent sections joined together, the first side of the sections of the second seal have an elongated cavity extending between the barbell-shaped sides of the section and the second side of the sections of the second seal has an elongated tab extending between the barbell sides of the section with the cavity and the tab sized for the tab of one section to fit into the cavity of another section and a portion of the barbell side at the first side of the sections, and a portion of the barbell side at the second side of the sections are shaped to overlap when the tab of one of the sections is in the cavity of the adjacent section, and further comprising screw members to secure the sides of adjacent members together and a rigid elongated member in each of the enlarged first and second sides to resist the barbell sides from moving out of their respective one of the chambers.

18. The expansion joint according to claim 1, further comprising a first seal retention member mounted on the first load-bearing member, a second seal retention member mounted on the second load-bearing member, and an elongated third seal between and connected to the first and second seal retention members.

19. The expansion joint according to claim 1, wherein at least one of the first seal and the second seal are made of a polymeric material.

20. The expansion joint according to claim 1, wherein the first load-bearing member has a major surface having one or more metal studs secured thereto and extending away from the major surface of the first load-bearing member, wherein the major surface of the first load-bearing member is secured against the vertical face of the first roadway section and the metal studs of the first load-bearing member are embedded in the first concrete roadway section with remaining surface portions of the first load-bearing member unsupported by concrete against force of gravity, and wherein the second load-bearing member has a major surface having one or more metal studs secured thereto and extending away from the major surface of the second load-bearing member, wherein the major surface of the second load-bearing member is secured against the vertical face of the second roadway section and the metal studs of the second load-bearing member are embedded in the second concrete roadway section with remaining surface portions of the second load-bearing member unsupported by concrete against force of gravity.

21. The expansion joint according to claim 11, wherein the first and second roadway sections are first and second concrete roadway sections, and wherein the second load-bearing member is an elongated second load-bearing member and the cavity of the second load-bearing member is a second elongated cavity and the opening of the cavity of the second load bearing member is an elongated opening, the second load-bearing member having an L-shaped cross section comprises a first leg joined to a second leg with the first leg of the second load-bearing member mounted to the vertical surface of the second roadway section and the second leg of the second load bearing member having a cutout end portion, and an elongated insert mountable on the cutout end portion to form the second retention cavity to receive the second side of the first seal with the elongated opening of the second retention cavity facing the first load-bearing member with the first seal extending out of the opening of the second elongated cavity, and wherein the second support member is an elongated second support member having an L-shaped cross section and comprises a first leg joined to a second leg, the first leg of the second support member mounted on the first leg of the second load-bearing member and secured thereto by at least one fastener passing through the first leg of the second support member and the first leg of the second load-bearing member into the second concrete roadway section.

22. A method of removing a primary seal from a road expansion joint mounted in a space between vertical faces of first and second roadway sections, the roadway sections having an upper surface and an opposite lower surface, the joint comprising:

a first load-bearing member mounted to the vertical face of the first section, the first load-bearing member having a retention cavity and an opening to provide access to the interior of the retention cavity;

a second load-bearing member mounted to the vertical face of the second section, the second load-bearing member spaced from the first load-bearing member, the second load-bearing member having a retention cavity and an opening to provide access to interior of the retention cavity of the second load-bearing member, with the opening of the retention cavity of the second load-bearing member facing the opening of the retention cavity of the first load-bearing member;

first and second support members, the first support member mounting the first load-bearing member and with the first load-bearing member providing a first chamber having an elongated opening, the second support member mounting the second load-bearing member and with the second load-bearing member providing a second chamber having an elongated opening, with the elongated openings of the first and second chambers facing one another;

an elongated first seal having a first side and an opposite second side, with the first side of the first seal in the retention cavity of the first load-bearing member and the second side of the first seal in the retention cavity of the second load-bearing member, wherein traffic moves over the first seal; and an elongated second seal having a first side and a second side, with the first side of the second seal in the first chamber and the second side of the second seal in the second chamber wherein the first and second seals are not secured to one another and are free to move independent of one another, the method comprising:

removing the second seal from under the expansion joint;

thereafter removing the first seal from above or below the expansion joint;

installing a replacement first seal from above or below the expansion joint; and thereafter installing the second seal or a replacement second seal from under the expansion joint.

23. The method according to claim 22, wherein the step of thereafter removing the first seal is practiced from below the expansion joint, and the step of installing a replacement first seal is practiced from below the expansion joint and further comprising moving traffic over the first surface of the roadway and the joint while practicing one or more of the removing, thereafter removing, installing, and thereafter installing steps.

* * * * *